US005882223A

United States Patent [19]

Igarashi

[11] Patent Number: 5,882,223

[45] Date of Patent: Mar. 16, 1999

[54] CONNECTOR WHICH IS ADAPTED TO CONNECT A FLAT CONNECTION OBJECT HAVING A SIGNAL PATTERN AND A SHIELD PATTERN OPPOSITE TO EACH OTHER

[75] Inventor: Isao Igarashi, Tokyo, Japan

[73] Assignee: Japan Aviation Delectronics Industry, Limited, Tokyo, Japan

[21] Appl. No.: 799,921

[22] Filed: Feb. 13, 1997

[30] Foreign Application Priority Data

Feb. 21, 1996 [JP] Japan ..... 8-033527

[51] Int. Cl.[6] ..... H01R 9/07

[52] U.S. Cl. ..... 439/495; 439/607; 439/95; 439/260

[58] Field of Search ..... 439/259, 260, 439/263, 264, 495, 496, 499, 570

[56] References Cited

U.S. PATENT DOCUMENTS

| | | | |
|---|---|---|---|
| 4,240,430 | 12/1980 | Goes | 439/260 |
| 4,640,562 | 2/1987 | Shoemaker | 439/495 |
| 5,354,214 | 10/1994 | Aso et al. | 439/495 |
| 5,401,186 | 3/1995 | Nozaki et al. | 439/495 |
| 5,498,169 | 3/1996 | Ikemoto | 439/260 |

*Primary Examiner*—Hien Vu

*Attorney, Agent, or Firm*—Laff, Whitesel, Conte & Saret, Ltd.

[57] ABSTRACT

In a connector for connecting a flat connection object with a circuit board having a signal circuit and an earth circuit, the flat connection object has a conductive signal pattern and a conductive shield pattern opposite to each other. The connector is provided with an insulator housing holding a conductive hold down which is used in fixing the insulator housing onto the circuit board and is connected to the earth circuit. In order to connect the signal pattern with a contact held to the housing, a pressing member is used and moved relative to the insulator housing. The pressing member is conductive and is brought into contact with the conductive shield pattern and with the conductive hold down when the pressing member makes the flat connection object be connected to the contact.

3 Claims, 4 Drawing Sheets

CONNECTOR WHICH IS ADAPTED TO CONNECT A FLAT CONNECTION OBJECT HAVING A SIGNAL PATTERN AND A SHIELD PATTERN OPPOSITE TO EACH OTHER

BACKGROUND OF THE INVENTION

This invention relates to a connector for use in connecting a flat connection object with a circuit board. As the flat connection object, use is made of an FPC (flexible printed circuit), an FFC (flexible flat cable), or the like.

In the manner known in the art, a recent computer uses a signal of a high frequency which is transmitted through a flat connection object and a connector for connecting the flat connection object. This results in externally emitting components of the high frequency as electric waves from the computer. The electric waves cause a noise in each of electric or electronic equipments surrounding the computer. In order to prevent the electric waves from being emitted, the recent computer is provided with metallic shield structure collectively covering various parts which are included in the recent computer. With this structure, the metallic shield structure becomes complicated to result in raising manufacturing cost of the recent computer.

In addition, it is preferable to provide the flat connection object with shield structure which is connected through the connector to a circuit board to electromagnetically shield the flat connection object. In this event, the connector must be provided with particular structure which is used in connecting the flat connection object with the circuit board. With this structure, the connector becomes complicated to result in raising its manufacturing cost.

SUMMARY OF THE INVENTION

It is therefore an object of this invention to provide a connector which is useful to electromagnetically shield a flat connection object.

It is another object of this invention to provide a connector of the type described, which has simple structure.

It is still another object of this invention to provide a connector of the type described, which is adapted to connect a flat connection object having a signal pattern and a shield pattern opposite to each other.

Other objects of this invention will become clear as the description proceeds.

A connector to which this invention is applicable is for connecting a flat connection object with a circuit board having a signal circuit and an earth circuit. The flat connection object has a conductive signal pattern on a main surface thereof and a conductive shield pattern on a supplementary surface thereof. The connector comprises an insulator housing for receiving the flat connection object, a conductive hold down held to the insulator housing for fixing the insulator housing onto the circuit board and for being connected to the earth circuit, a conductive contact held to the insulator housing to face the flat connection object for being connected to the signal circuit, and a pressing member movable relative to the insulator housing for pressing the flat connection object with movement thereof to make the conductive signal pattern become in contact with the conductive contact. The pressing member is conductive and is brought into contact with the conductive shield pattern and with the conductive hold down when the pressing member presses the flat connection object.

DESCRIPTION OF THE PREFERRED EMBODIMENT

Referring to FIGS. 1 through 4, description will be made as regards a connector according to a first embodiment of this invention. The connector is for connecting a flexible cable 10 with a circuit board (not shown) which has a signal circuit and an earth circuit in the manner known in the art.

Figure 5:
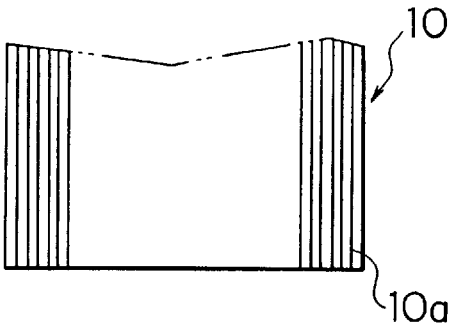
FIG. 5 is a bottom view of the flexible cable illustrated in FIG. 1.
Figure 6:
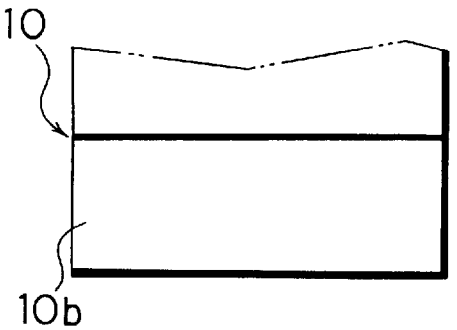
FIG. 6 is a plan view of the flexible cable illustrated in FIG. 1.

Referring to FIGS. 5 and 6 shortly, the flexible cable 10 will be described. The flexible cable 10 has a plurality of conductive signal patterns 10*a* on a main or lower surface thereof and a conductive shield pattern 10*b* on a supplementary or upper surface thereof. The signal patterns 10*a* are arranged to have a predetermined pitch and extends along the lower surface of the flexible cable 10 in parallel to one another as shown in FIG. 5. Each of the signal patterns 10*a* is exposed only at one end portion of the flexible cable 10. The shield pattern 10*b* is formed to cover all of the upper surface and is exposed only at the one end of the flexible cable 10 as shown in FIG. 6. The flexible cable 10 is referred to as a flat connection object.

Returning back to FIGS. 1 through 4, the description will be made as regards the connector in detail. In the manner which will presently be described, the connector comprises an insulator housing 12, a conductive hold down 13, a plurality of conductive contacts 14, and a conductive slider 15.

The housing 12 is made of an insulating material such as a synthetic resin or the like and has a wall portion 12*a* defining, at a front end side of the housing 12, an opening or a hollow portion 16 to receive the one end portion of the flexible cable 10.

The hold down 13 is made of a metal plate having conductivity. In the manner known in the art, the hold down 13 is held to an end of the housing 12 and serves as a fixing member to fix the housing 12 onto the circuit board (not shown). In addition, the hold down 13 has a concave portion 13*a* and a fixing portion 13*b* connected to the signal circuit of the circuit board by soldering or the like.

Each of the contacts 14 is made of a metal plate having conductivity. The contacts 14 are arranged in parallel to each other within the housing 12 to have the predetermined pitch in a first direction. Each of the contacts 14 has a contact portion 14*a* at its front end portion and a terminal portion 14*b* at its rear end portion. The terminal portion 14*b* is connected to the signal circuit of the circuit board by soldering or the like.

The slider 15 is made of a metal having conductivity. The slider 15 is movable relative to the housing 12 between a first and a second position which is different from one another in a second direction perpendicular to the first direction. When placed in the first position, the slider 15 is inserted between the wall portion 12*a* of the housing 12 and the flexible cable 10. In this event, the slider 15 presses downwardly the one end portion of the flexible cable 10. Consequently, each of the signal patterns 10*a* of the flexible cable 10 is brought into contact with the contact portion 14*a* of each of the contacts 14. Therefore, the signal patterns 10*a* are electrically connected to the signal circuit of the circuit board through the contacts 14.

In addition, the slider 15 has a connecting portion 15*a* extending along the end of the housing 12 in the second direction. When the slider 15 is placed in the first position, the connecting portion 15*a* is closely fitted into the concave portion 13*a* of the hold down 13. In other words, the slider 15 and the hold down 13 are electrically connected to each other by press-fitting structure therebetween. Simultaneously, the slider 15 is brought into contact with the shield pattern 10*b* of the flexible cable 10. Therefore, the shield pattern 10*b* is electrically connected to the earth circuit of the circuit board through the slider 15 and the hold down 13. The slider 15 is referred to as a pressing member.

When moved from the first position to the second position in the second direction, the slider 15 does not press the flexible cable 10 against the contact portion of each of the contacts 4. Therefore, it become readily possible to remove the flexible cable 10 from the connector in the second direction.

The description will be directed to operation of connecting the cable 10 with the connector. First, the one end of the flexible cable 10 is inserted into the housing 2 through the opening 16. After that, the slider 15 is also inserted between the wall portion 12*a* and the cable 10 through the opening 16. Consequently, the signal patterns 10*a* of the cable 10 are brought into contact with the contacts 14, respectively. Therefore, each of the signal patterns 10*a* is connected to the signal circuit of the circuit board through the terminal portion 14*b* of each of the contacts 14. In other words, each of the signal patterns 10*a* and the signal circuit of the printed board are electrically connected to each other.

Further, the slider 15 is made conductive upon contacting with the shield pattern 10*b* of the flexible cable 10 and is also made conductive upon contacting with the hold down 13. Consequently, the shield pattern 11 is electrically connected to the earth circuit of the circuit board through the slider 15 and the hold down 13, thereby shielding of the signal patterns 10*a* of the flexible cable 10 is achieved.

Figure 8:
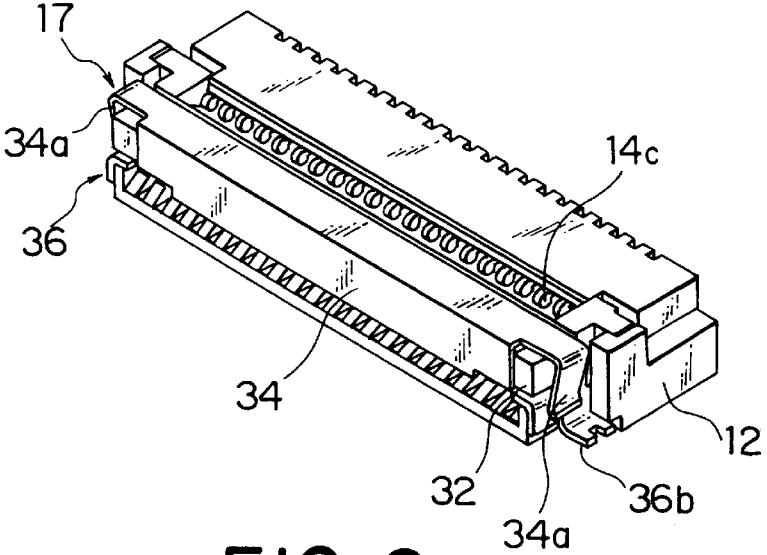
FIG. 8 is a perspective view of the connector of FIG. 7.
Figure 7:
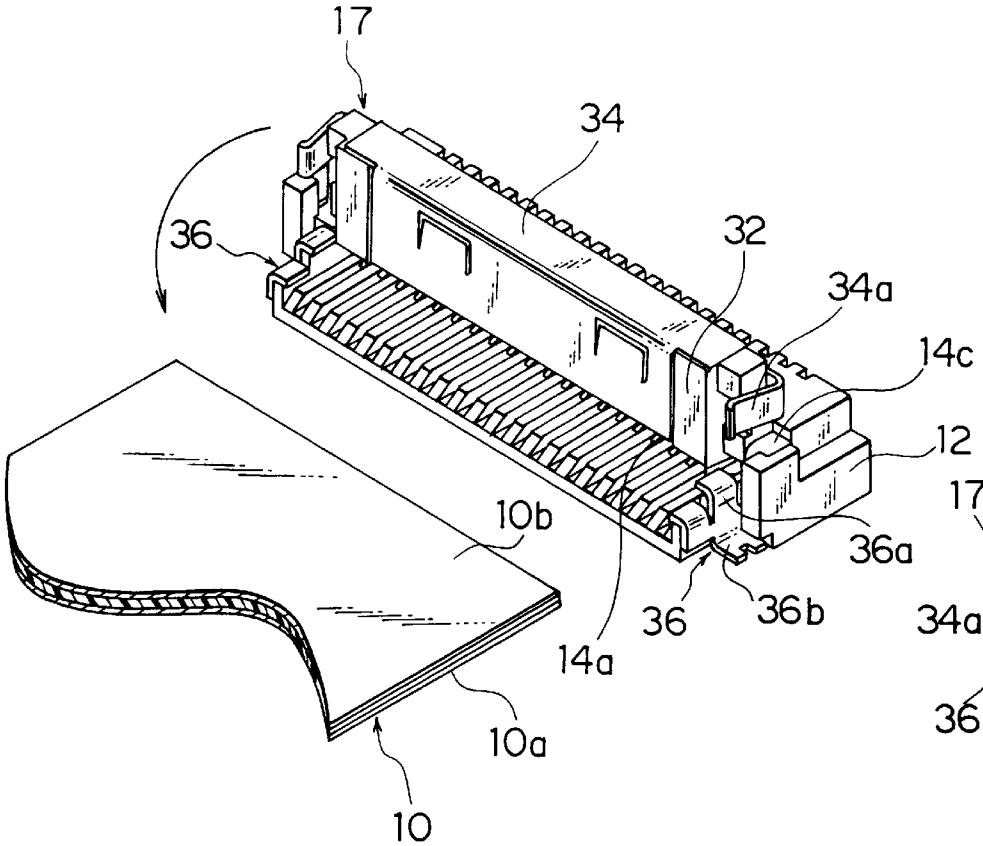
FIG. 7 shows, together with the flexible cable, a perspective view of a connector according to a second embodiment of this invention.
Figure 9:
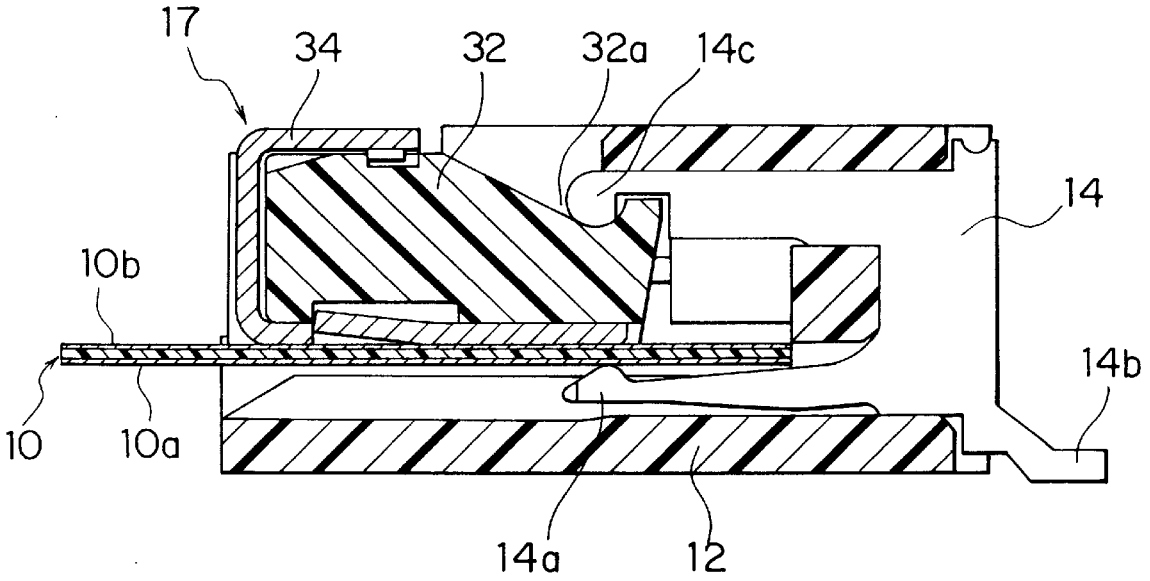
FIG. 9 is a sectional side view of the connector of FIGS. 7 and 8.

Referring to FIGS. 7 through 9, the description will be made as regards a connector according to a second embodiment of this invention. The connector comprises similar parts designated by like reference numerals.

Figure 1:
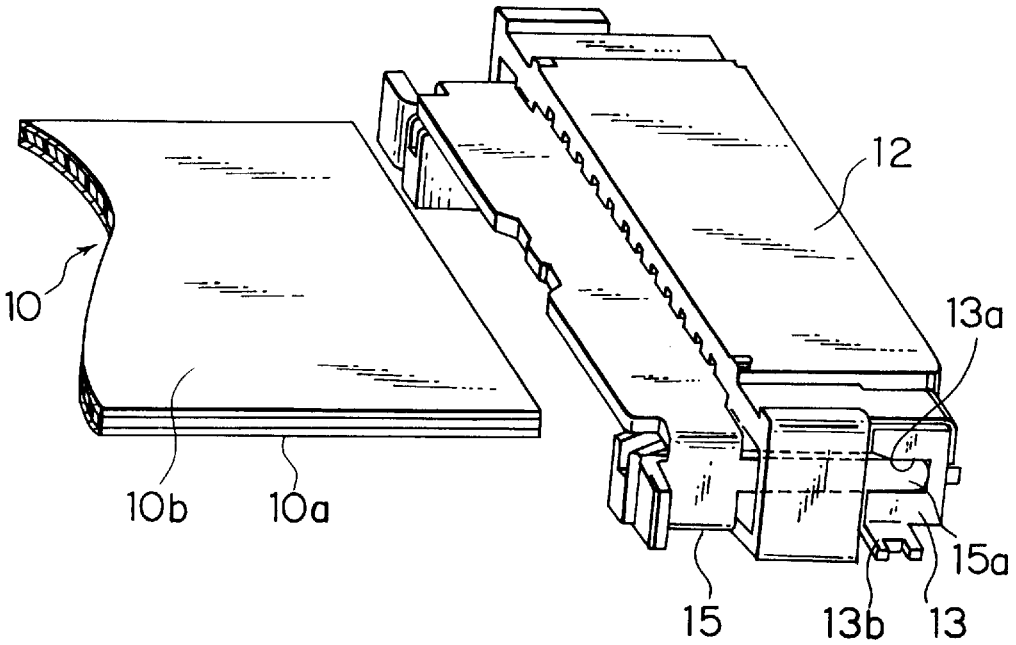
FIG. 1 shows, together with a flexible cable, a perspective view of a connector according to a first embodiment of this invention.
Figure 2:
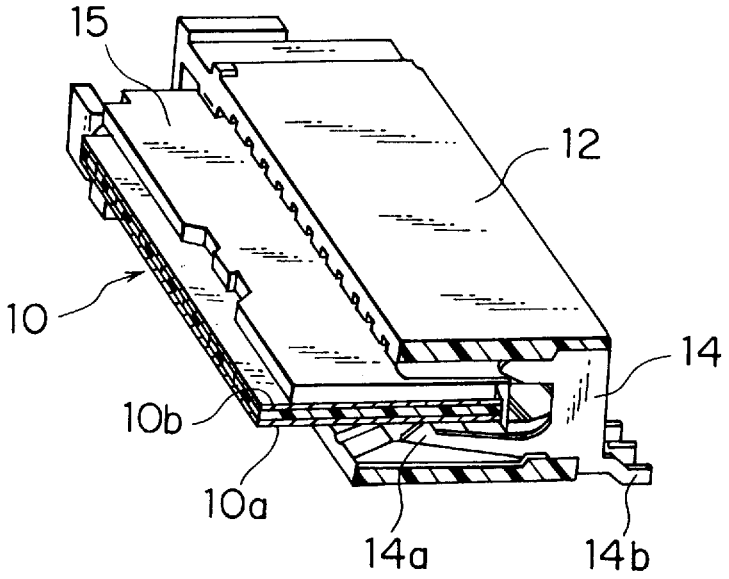
FIG. 2 is a partly sectional perspective view of the connector of FIG. 1, wherein the flexible cable is connected to the connector.
Figure 3:
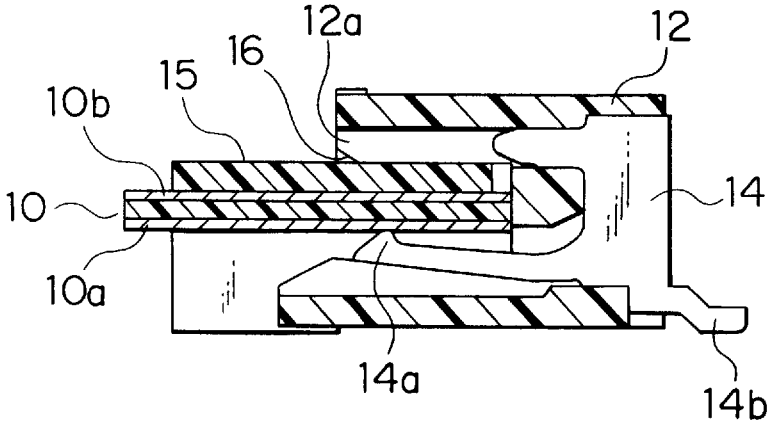
FIG. 3 is a sectional side view of the connector of FIG. 2.
Figure 4:
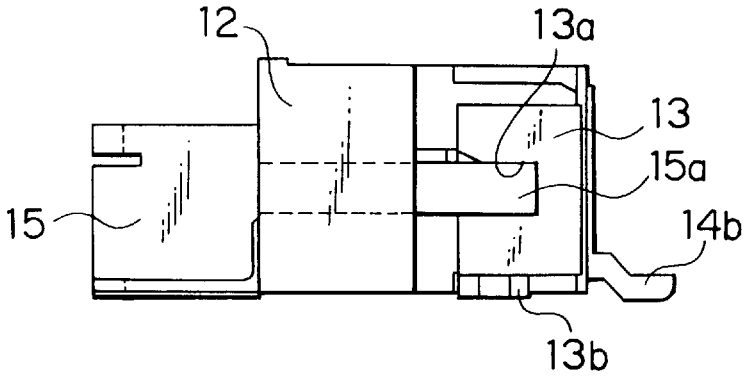
FIG. 4 is a side view of the connector illustrated in FIG. 1.

Instead of the slider 15 in FIGS. 1 through 3, the connector has a pressing member 17 for pressing the flat cable 10 with movement thereof to make the conductive signal patterns 10*a* become in contact with the contacts 14. In the manner which will later be described in detail, the pressing member 17 comprises a pivotal member 32 made of insulating material and a conductive shell 34 held to the pivotal member 32 to cover the pivotal member 32.

Through the opening 16 of the housing 12, one end portion of the flexible cable 10 is inserted or received into the housing 12. The flexible cable extends along a predetermined plane parallel to the first and the second directions.

Each of the contacts 14 has a pivotally supporting portion 14*c* in addition to the contact portion 14*a* and the terminal portion 14*b*. The pivotally supporting portion 14*c* is engaged with the pivotal member 32 to rotatably support the pivotal member 32. As a result, the pressing member 17 is pivotal around a predetermined axis parallel to the predetermined plane.

The pivotal member 32 has a concave portion 32*a* which is formed at a front end portion of the pivotal member 32 and adapted to be engaged with the pivotally supporting portion 14*c* of each of the contacts 14. By this engagement between the concave portion 32*a* and the pivotally supporting portion 14*c*, the pressing member 17 is pivotally supported by the contacts 14 so as to be rotatable with respect to the housing 12.

When being pivotally moved, the pressing member 17 opens and closes the upper portion of the opening 12*a* of the housing 12. When the pressing member 17 opens the opening 12*a* of the housing 12, it become readily possible to insert one end portion of the flexible cable 10 into the opening 12*a* of the housing 12.

After the one end of the flexible cable 10 is inserted into the housing 12 through the opening 12*a*, the pressing member 17 is pivotally moved towards the flexible cable 10. As a result, each of the signal patterns 10*a* of the flexible cable 10 is brought in press contact with the contact portion 14*a* of each of the contacts 31. Therefore, the signal patterns 10*a* are electrically connected to the signal circuit of the circuit board through the contacts 14. Simultaneously, the shell 34 is brought in press contact with the shield pattern 10*b* of the flexible cable 10.

Furthermore, a pair of hold downs 36 are held by press-fitting over each of end portions of the housing 12 in the first direction, respectively. Each of the hold downs 36 is slightly different from the above-mentioned hold down of FIGS. 1, 2, and 4 in a form thereof but is similar to that in a function thereof in the manner which will presently become clear.

Each of the hold downs 36 is made of a metal plate and has a contact portion 36*a* extending along each end surface of the housing 12 and a fixing portion 36*b* for being fixed to the circuit board by soldering or the like. The contact portions 36*a* of the hold downs 34 are opposite to each other to have a first distance in the second direction.

The shell 34 has a pair of contact portions 34*a* at end portions thereof in the first direction. The contact portions 34*a* are opposite to each other to have a second distance in the second direction. Herein, the second distance is slightly smaller that the first distance.

When the pressing member 17 is pivotally moved towards the flexible cable 10 to make each of the signal patterns 10*a* of the flexible cable 10 be brought in press contact with the contact portion 14*a* of each of the contacts 31, each contact portions 34*a* of the shell 34 become in press contact with each contact portion 36*a* of the hold downs 36 as best shown in FIG. 8. Therefore, the shielded pattern 10*b* is electrically connected to the earth circuit of the circuit board through the shell 34 and the hold downs 13.

While the present invention has thus far been described in connection with a few embodiments thereof, it will readily be possible for those skilled in the art to put this invention into practice in various other manners. For example, the hold down 3 may have at least a portion which is conductive and electrically connects the slider 15 with the earth circuit of the circuit board. Similarly, the slider 15 may have at least a portion which is conductive and electrically connect the hold down 13 with the shield pattern 10*b* of the flexible cable 10. The connecting portion 15*a* of the slider 15 may have a concave portion with the hold down having a portion which is closely fitted into the concave portion of the slider 15. It is a matter of course that a printed board may be used as the circuit board. As a flat connection object, use may be made of a flexible printed circuit, a flexible flat cable, or the like.

What is claimed is:

1. An electrical connector for electronically connecting a flat connection object with a circuit board having a signal circuit and an earth circuit, said flat connection object having a conductive signal pattern on a main surface thereof and a conductive shield pattern on an opposite and supplementary surface thereof, said connector comprising:

an insulator housing having a first wall, a second wall and a space between said walls for receiving said flat connection object;

a conductive hold down attached to said insulator housing for fixing said insulator housing onto said circuit board, said hold down being connected to said earth circuit;

a conductive contact held by said insulator housing to engage with said flat connection object for being connected to said signal circuit; and an electrically conductive slider which is movable relative to said insulator housing, said slider moving into said space and between said flat connection object and one of said walls with said movement of said slider making said conductive signal pattern come into contact with said conductive contact, said slider coming into contact with said conductive shield pattern and with said conductive hold down when said slider presses said flat connection object.

2. A connector as claimed in claim 1, wherein said conductive hold down is located at an end of said insulator housing, said slider having a connecting portion which extends along said end of the insulator housing and comes into contact with said conductive hold down when said slider presses said flat connection object.

3. A connector as claimed in claim 2, wherein said connecting portion and said conductive hold down are press-fitted against each other.

* * * * *